US007370950B2

(12) United States Patent
Amemiya

(10) Patent No.: US 7,370,950 B2
(45) Date of Patent: May 13, 2008

(54) ELECTRONIC DEVICE, REPLACEMENT PART THEREOF, PACKAGE OF REPLACEMENT PART, AND METHOD FOR ARRANGING IDENTIFYING SECTION

(75) Inventor: Kanae Amemiya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 438 days.

(21) Appl. No.: 10/991,414

(22) Filed: Nov. 19, 2004

(65) Prior Publication Data

US 2005/0128257 A1 Jun. 16, 2005

(30) Foreign Application Priority Data

Nov. 19, 2003 (JP) ..... 2003-388820

(51) Int. Cl.
*B41J 2/175* (2006.01)

(52) U.S. Cl. ..... 347/86; 347/85; 347/108

(58) Field of Classification Search ..... 347/86
See application file for complete search history.

(56) References Cited

U.S. PATENT DOCUMENTS 5,519,422 A * 5/1996 Thoman et al. ..... 347/49
5,530,531 A * 6/1996 Girard ..... 399/120
6,151,041 A * 11/2000 Bolash et al. ..... 347/19
2006/0139420 A1* 6/2006 Muranaka et al. ..... 347/86

FOREIGN PATENT DOCUMENTS

JP 06-336030 12/1994

* cited by examiner

*Primary Examiner*—Matthew Luu
*Assistant Examiner*—Brian J. Goldberg
(74) *Attorney, Agent, or Firm*—Oblon, Spivak, McClelland, Maier & Neustadt, P.C.

(57) ABSTRACT

An ink cartridge used in a color printer, comprises at the surface, a convexity or convexities (identifying section) that correspond to a color of an ink, and that can be identified by tactile sense. A cartridge setting section of the color printer comprises at the surface, a convexity or convexities (identifying section) that correspond to the color of the ink of the ink cartridge that is to be set, and that can be identified by tactile sense. The user can identify the color of the ink of the ink cartridge, by touching the ink cartridge with his/her hand, and obtain information of the position where that ink cartridge should be set, by touching the cartridge setting section with his/her hand.

5 Claims, 6 Drawing Sheets

ELECTRONIC DEVICE, REPLACEMENT PART THEREOF, PACKAGE OF REPLACEMENT PART, AND METHOD FOR ARRANGING IDENTIFYING SECTION

BACKGROUND OF THE INVENTION

1. Field of the Invention

The present invention relates to an electronics device, a replacement part for the electronics device, and a package of the replacement part, and especially to an electronics device, a replacement part for the electronics device, a package of the replacement part each comprising an identifying section for specifying/determining information on the content, etc., and a method for arranging identifying section.

2. Description of the Related Art

In Unexamined Japanese Patent Application KOKAI Publication No. H6-336030, a color inkjet printer or a color copying machine comprising a structure where an ink cartridge can be attached or moved to/from a storing unit, is disclosed. At the outer packaging box of these ink cartridges, information indicating the content, for example, information indicating what color of ink that ink cartridge stores, is written by a visual method, such as a number or note of the color, etc.

As described above, information on the content is written on the outer packaging box of the ink cartridge, only by a visual method. Therefore, for example, it is difficult for a visually impaired person to obtain information on the content, from an un-opened outer packaging box. Also, in such a case that an ink cartridge should be replaced at a dark place, it is difficult for even a person not visually impaired to adequately select the ink cartridge required for the replacement.

Further, in many cases, in addition to the outer packaging box, the ink cartridge is wrapped by a plastic inner packaging etc., for keeping the high air-tightness for the cartridge and protecting the cartridge as content. Therefore, it is convenient if the information on the content can be obtained without opening the inner packaging.

Also, as to a case where replacement parts similar in their shapes or the like are handled, for example, a case where ink cartridges different in the colors of their contained inks are to be put on their carriages, the person who handles these replacement parts sometimes cannot decide the relation between each of the parts and each of the setting positions corresponding to each of the parts. And in such cases, it is inconvenient to handle the replacement part.

SUMMARY OF THE INVENTION

The present invention has been made in consideration of the aforementioned circumstances, and an object of the present invention is to realize a replacement part that can be easily handled, replaced, and attached, etc. a packaging thereof, and an electronics device, etc.

Another object of the present invention is to provide an electronics device to which a specific replacement part can be attached.

Another object of the present invention is to provide a replacement part from which information on its content, etc., can be easily obtained/recognized, and for which the position where it is to be attached can be easily specified/determined, and an electronics device to which the replacement part can be attached.

Still another object of the present invention is to realize a replacement part from which information on its content, etc., can be obtained/recognized under the condition that it is packaged, a package thereof, and an electronics device in which the position where the replacement part is to be attached, or the like can be easily specified.

To achieve the above objects, according to a first aspect of the present invention, there is provided an electronics device which is used with plural types of replacement parts being set thereto, the electronics device comprising a plurality of setting sections in each of which corresponding one of the plural types of replacement parts is set, wherein:

each setting section comprises an identifying section that has an outer shape for identification, which represents the type of the replacement part that is to be set to the setting section; and each of the replacement parts, in accordance with its type, has an identifying section that has an outer shape corresponding to the outer shape of the identifying section of the setting section where each replacement part is to be set.

According to this invention, the user can set the replacement part to the corresponding predetermined setting section, based on tactile information.

The replacement part may be preserved by being packaged by a predetermined package; and the package may comprise an identifying section that has an outer shape for identification, representing the type of the replacement part that is packaged therein.

According to this invention, it is possible for the user to determine with his tactile sense whether the information obtained from the package and the actual replacement part match or not, when the user opens the package and takes out the replacement part as the content of the package.

The replacement part may store a predetermined consumables used in the electronics device, and the identifying section of the replacement part may have an outer shape that corresponds to the type of consumables.

According to this invention, it is possible for the user to set the consumables to the setting section of the electronics device where the consumables is to be set, based on the information obtained by tactile sense.

The electronics device may be a printing device, and the replacement part may store an ink used for printing by the printing device, and the identifying section of the replacement part may have an outer shape that corresponds to the type of ink stored in the replacement part.

According to this invention, it is possible for the user to determine which color of ink should be set to which setting section of the printing device, only with the information obtained by tactile sense.

According to a second aspect of the present invention, there is provided an electronics device which is used with plural types of replacement parts being set thereto, the electronics device comprising a plurality of setting sections in each of which corresponding one of the plural types of replacement parts is set, wherein each setting section comprises an identifying section that has an outer shape for identification, which represents the type of replacement part that is to be set thereto.

The electronics device according to the second aspect of the present invention may be a printing device;

the replacement part may store ink used in printing by the printing device; and the identifying section of each setting section preferably has an outer shape that corresponds to the color of the ink stored in the replacement part set to the setting section.

Replacement parts according to a third aspect of the present invention, are plural types of replacement parts used by being set to an electronics device, wherein:

the electronics device comprises a plurality of setting sections in each of which corresponding one of the plural types of replacement parts is set; and each of the replacement parts, in accordance with its type, comprises an identifying section that has an outer shape for identification, which corresponds to the setting section in which the replacement part is to be set.

The electronics device may be a printing device, the replacement part may store ink for the printing device, and the identifying sections of the replacement part preferably has an outer shape corresponding to the type of ink stored in the replacement part.

A package for a replacement part according to a fourth aspect of the present invention, packages a replacement part used for an electronics device, the package comprising an identifying section that has an outer shape for identification, which represents a type of the replacement part that is to be packaged in the package.

The electronics device may be a printing device, the replacement part may store ink for the printing device, and the identifying section of the package preferably has an outer shape that corresponds to the type of the ink stored in the replacement part that is to be packaged in the package.

A method for arranging an identifying section according to a fifth aspect of the present invention comprises:

arranging to each of a plurality of setting sections of an electronics device in each of which a corresponding one of plural types of replacement parts is to be set, an identifying section having an outer shape for identification representing the type of the replacement part to be set in each setting section, the electronics device being used with the plural types of replacement parts being set therein;

arranging to each of the replacement parts to be set to the setting sections, an identifying section having an outer shape for identification that corresponds to the outer shape of the identifying section of the setting section in which each replacement part is to be set; and arranging to each of packages which package the replacement parts, an identifying section having an outer shape for identification that represents the type of the replacement part packaged therein.

In the method for arranging an identifying section, the outer shape of the identifying section of a predetermined setting section, the outer shape of the identifying section of a predetermined replacement part to be set to the predetermined setting section, and the outer shape of the identifying section of the package that is to package the predetermined replacement part, are preferably substantially the same or in one to one correspondence.

According to the present invention, for example, the information of the identifying section can be obtained by a user by touching the identifying section with his/her hands, and information concerning an electronics device or a replacement part can be easily obtained in a dark place, or by a person who is visually impaired.

BRIEF DESCRIPTION OF THE DRAWINGS

These objects and other objects and advantages of the present invention will become more apparent upon reading of the following detailed description and the accompanying drawings in which.

Figure 3B:
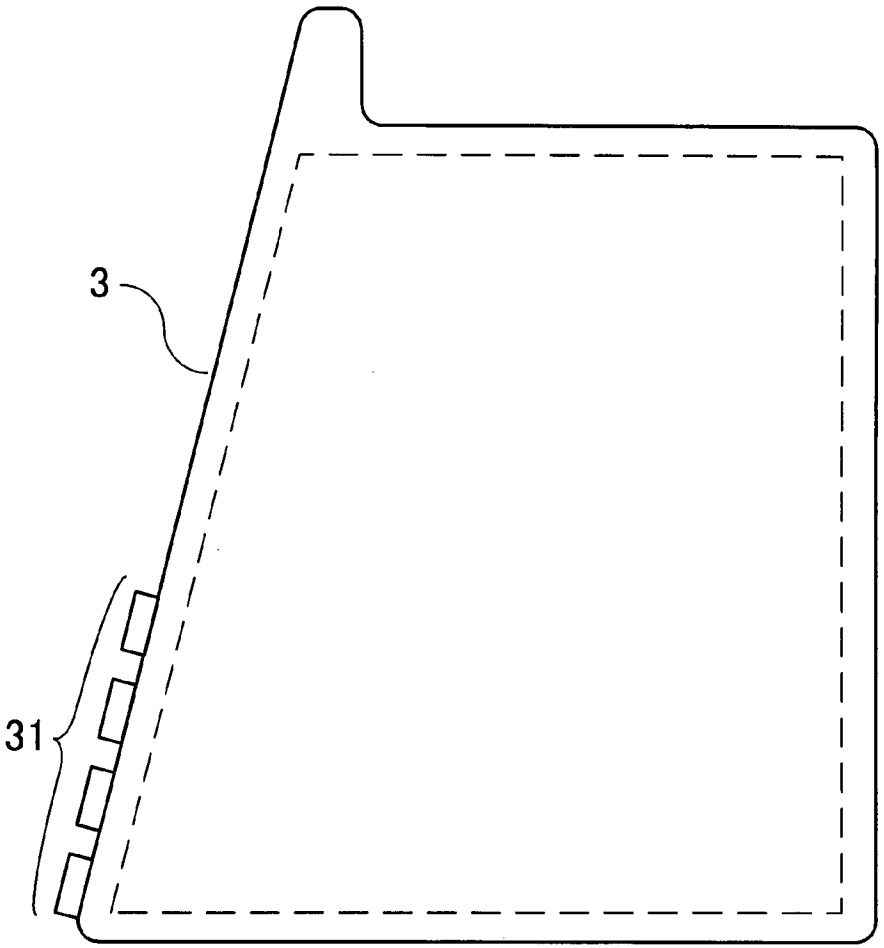
Figure 3A:
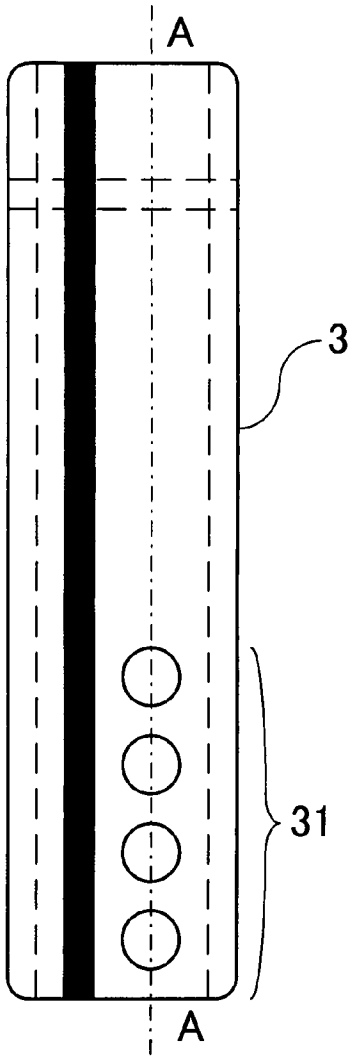
Figure 4B:
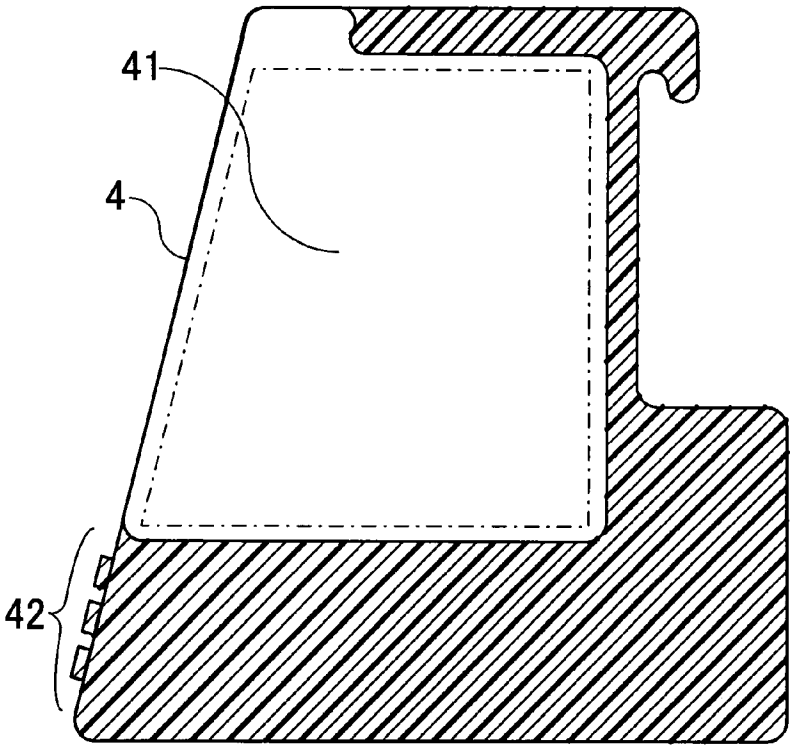
Figure 4A:
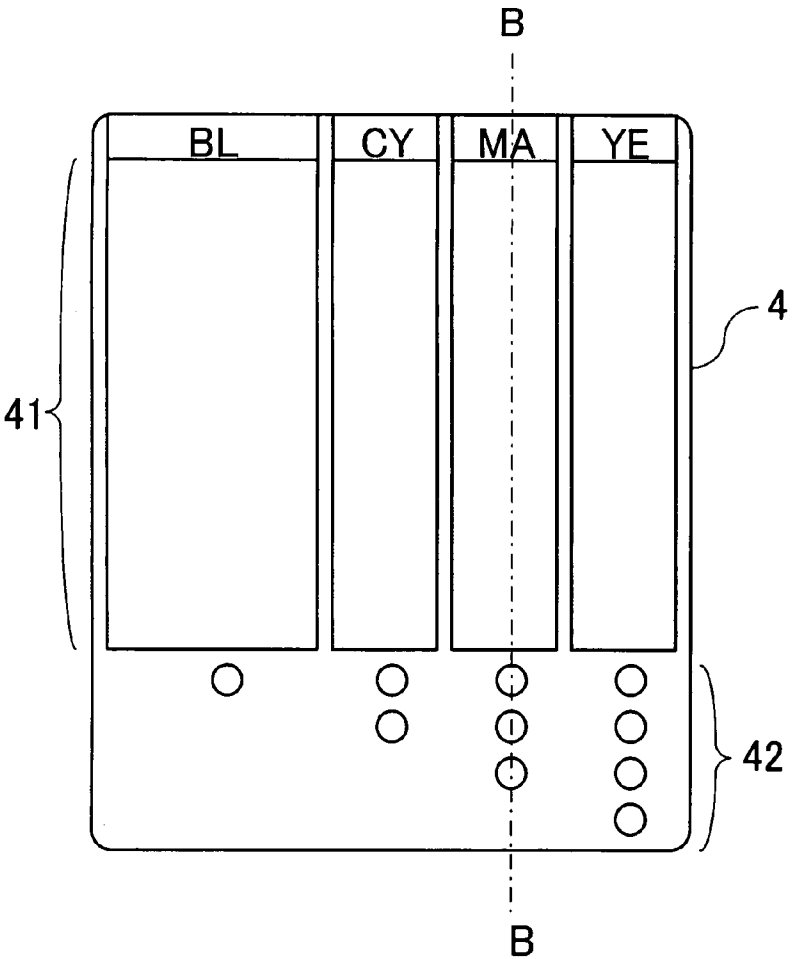
Figure 5:
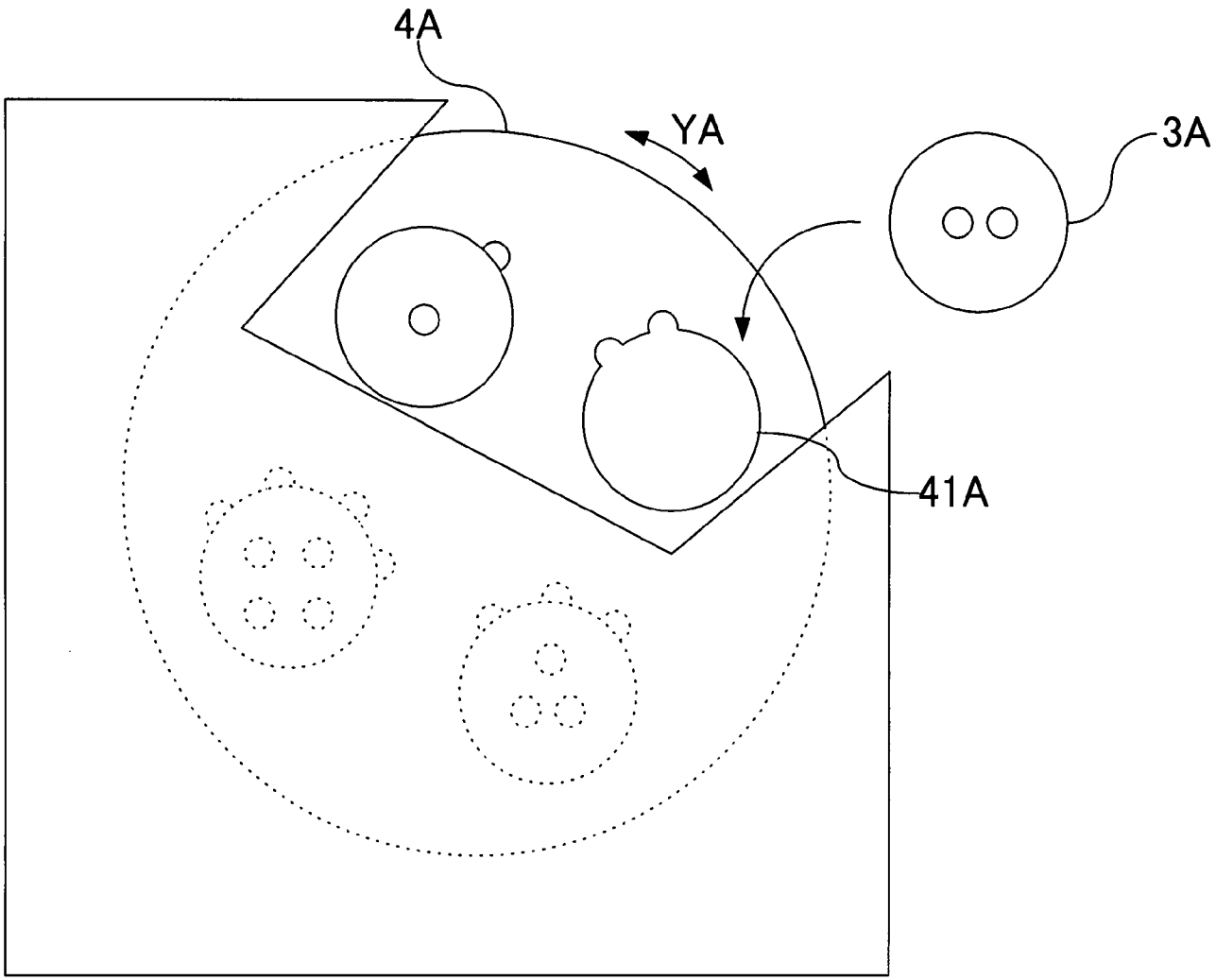
Figure 6B:
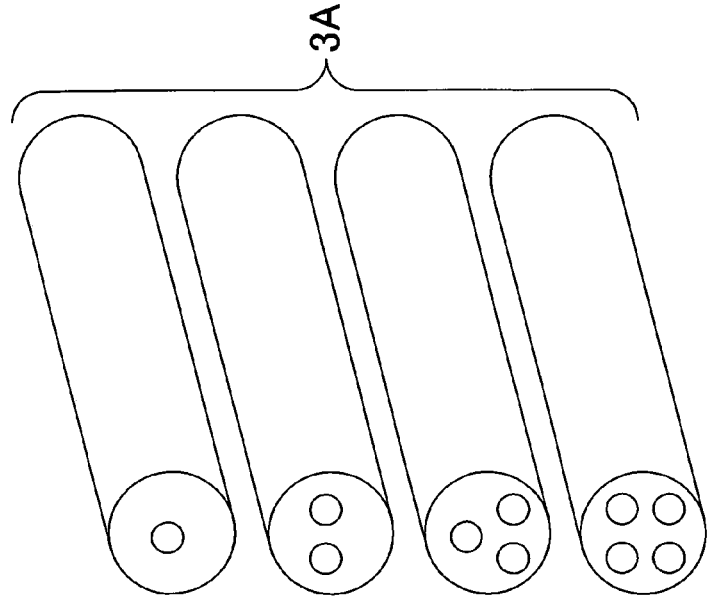
Figure 6A:
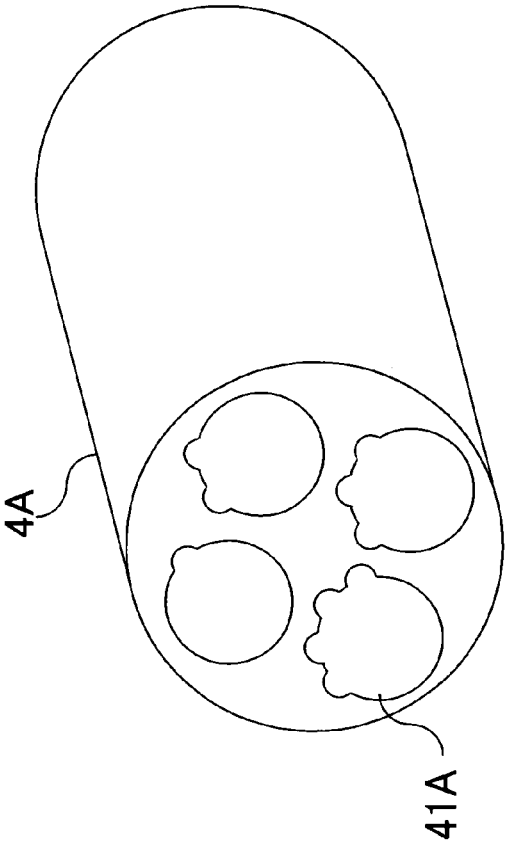
Figure 6C:
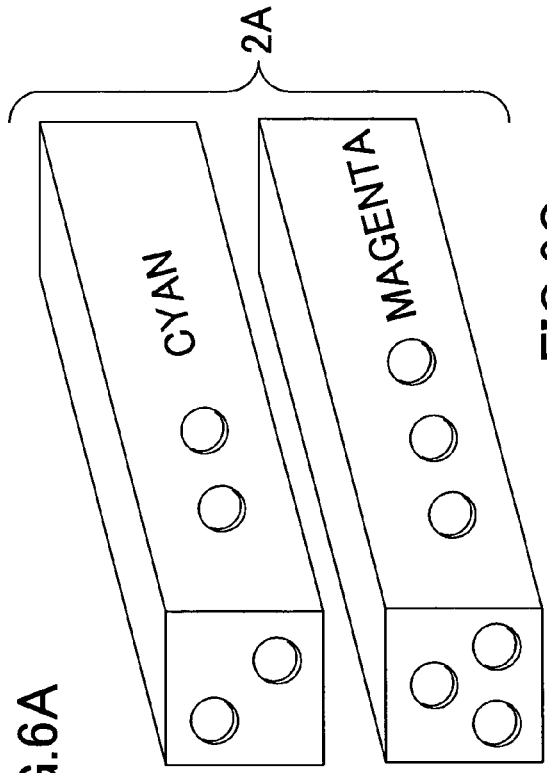

Each of FIG. 2A through FIG. 2D is an outside view of the outer packaging box for the ink cartridge according to the embodiment of the present invention;

FIG. 3A is a front view of the ink cartridge according to the embodiment of the present invention;

FIG. 3B is a cross-sectional view of the ink cartridge when it is sectioned along A-A of FIG. 3A;

FIG. 4A is front view of the cartridge setting section according to the embodiment of the present invention;

FIG. 4B is a cross-sectional view of the cartridge setting section when it is sectioned along B-B of FIG. 4A;

FIG. 5 is a diagram showing an example where the present invention is applied to a toner cartridge setting section of a laser printer, and a toner cartridge;

FIG. 6A is a perspective view of the toner cartridge setting section of the laser printer, and shows an outer shape of the toner cartridge setting section of the laser printer;

FIG. 6B is a perspective view of the toner cartridge of the laser printer, and shows an outer shape of the toner cartridge of the laser printer; and FIG. 6C is a perspective view of the outer packaging box that stores the toner cartridge, and shows an outer shape of the outer packaging box.

DETAILED DESCRIPTION OF THE PREFERRED EMBODIMENT

An electronics device, a replacement part thereof, and a package of the replacement part will be described with reference to the drawings, by employing as examples, a color printer, an ink cartridge, and an outer packaging box of the ink cartridge.

Figure 1:
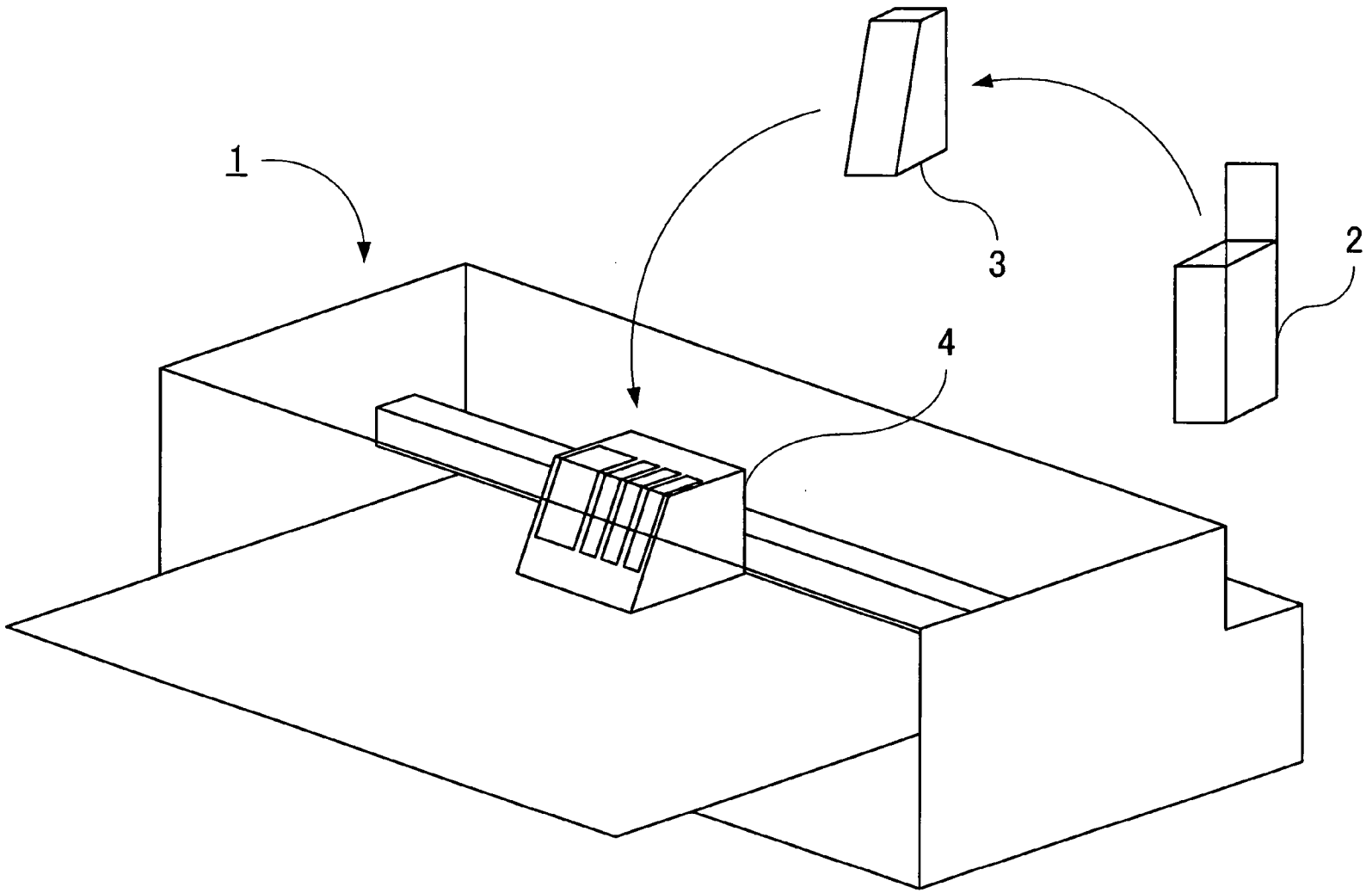
FIG. 1 is a diagram showing an operation of an ink cartridge according to an embodiment of the present invention, being taken out from an outer packaging box, and set to a cartridge setting section of a color printer.
Figure 2D:
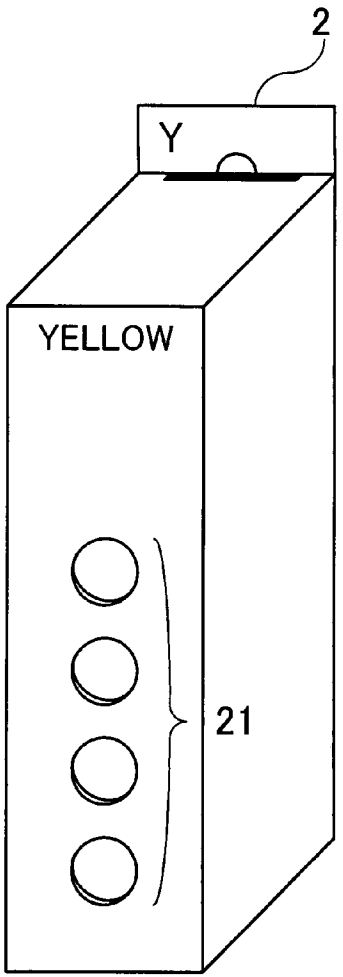
Figure 2C:
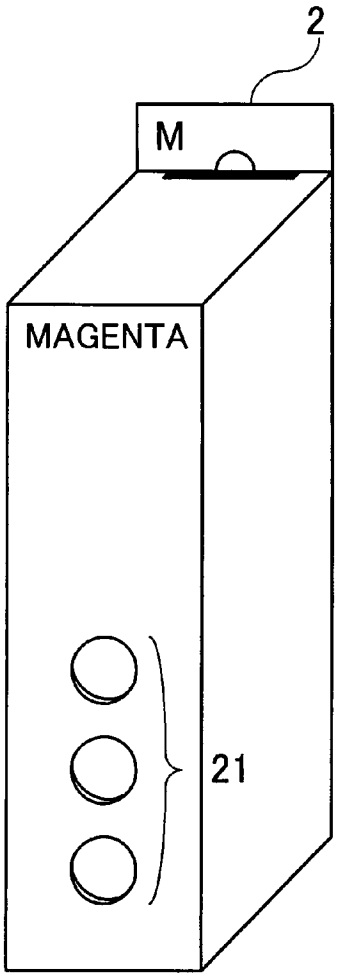
Figure 2B:
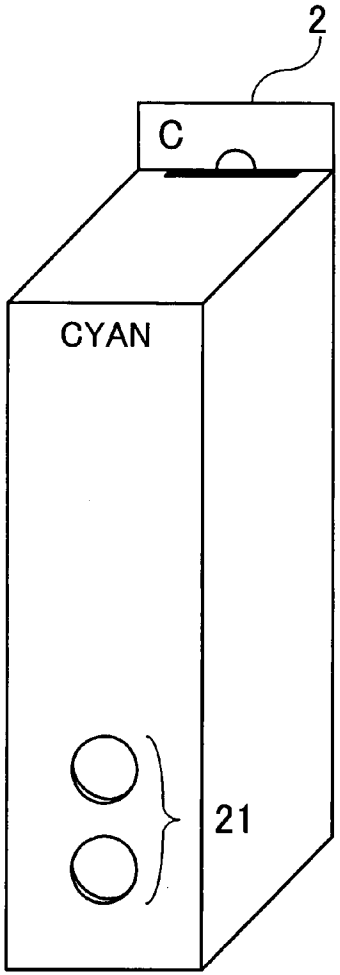
Figure 2A:
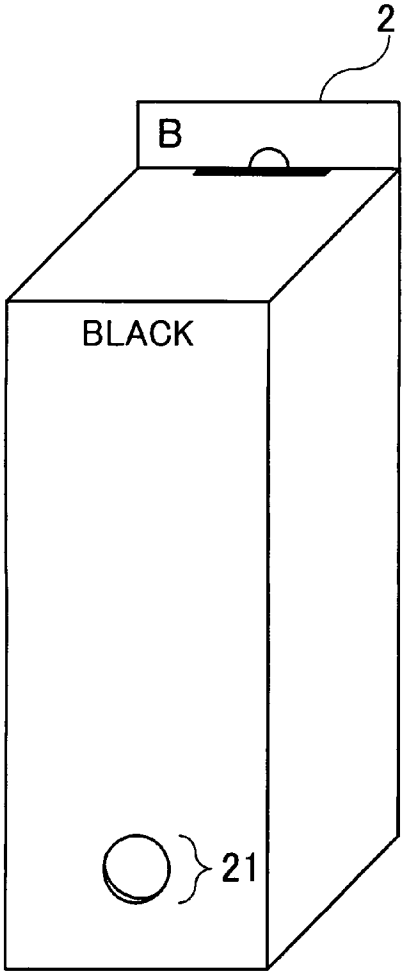

An outer packaging box 2 according to the present embodiment is a package for packaging an ink cartridge 3. As shown in FIG. 1, the ink cartridge 3 is used by being taken out from the outer packaging box 2, and being inserted into a predetermined portion in a cartridge setting section 4 of a carriage of a color printer 1.

As shown in FIG. 2A through FIG. 2D, the outer packaging box 2 comprises a round-shaped perforation/perforations (an identifying section for identifying the type of the content) positioned at a predetermined position (21 in FIG. 2A through FIG. 2D) on the front surface. The outer packaging box 2 includes at least one perforation. The number of perforations indicates the color of the ink of the ink cartridge 3, which is the content of the outer packaging box 2. More specifically, the number of perforations corresponds to the color of each ink, in a way such as, one perforation=black ink, two perforations=cyan ink, three perforations=magenta ink, and four perforations=yellow ink. The perforation/perforations has/have a size large enough and an interval relative to the others large enough to enable the user of the ink cartridge 3 to identify the number of perforation/perforations when he/she directly touches the corresponding portion (21 in FIG. 2A through FIG. 2D) of the outer packaging box 2.

As shown in FIGS. 3A and 3B, the ink cartridge 3 comprises a round-shaped convex shape or convex shapes (an identifying section for identifying the type of the ink) at a predetermined position (31 in FIG. 3A, FIG. 3B) on the front surface. FIG. 3A is a front view of the ink cartridge 3, and FIG. 3B is a cross-sectional view of the ink cartridge 3 when it is sectioned along a chain line A-A of FIG. 3A. The number of convex shapes indicates the color of the ink of each ink cartridge 3 and corresponds to the color of each ink one to one such as, one convex shape=black ink, two convex shapes=cyan ink, three convex shapes=magenta ink, and four convex shapes=yellow ink, in the same way as the case of the perforation/perforations in the outer packaging box 2 above described. The convex shape/shapes has/have an area and height large enough and an interval relative to the others large enough to enable the user to identify the number of convex shape/shapes when he/she directly touches the corresponding portion (31 in FIG. 3A, FIG. 3B) of the ink cartridge 3.

The cartridge setting section 4 comprises a round-shaped convex shape/shapes (convex section) at the portion below an ink cartridge inserting section 41 (42 in FIG. 4A, FIG. 4B), as shown in FIGS. 4A and 4B. FIG. 4A is a front view of the cartridge setting section 4, and FIG. 4B is a cross-sectional view of the cartridge setting section 4 when it is sectioned along a chain line B-B of FIG. 4A.

The number of convex shapes indicates the color of the ink of a corresponding ink cartridge 3 to be inserted into the ink cartridge inserting section 41, and corresponds to the color of each ink one to one such as, one convex shape=black ink, two convex shapes=cyan ink, three convex shapes=magenta ink, and four convex shapes=yellow ink, in the same way as the case of the convex shape/shapes of the ink cartridge 3 above described.

Also, the convex shape/shapes of the cartridge setting section 4 has/have a size large enough and an interval relative to the others large enough to enable the user of the ink cartridge 3 to identify the number of convex shape/shapes when he/she directly touches the portion below the ink cartridge inserting section 41 (42 in FIG. 4A, FIG. 4B).

As described above, each of the ink cartridge 3, the outer packaging box 2, and the cartridge setting section 4 of the color printer 1 according to the present embodiment, comprises a convex shape/shapes (convex section) or a perforation/perforations that corresponds/correspond to the color of each ink. Thereby, the user can identify the ink cartridge 3 required for replacement and the position in the cartridge setting section 4 where the ink cartridge 3 is to be inserted, only by his/her feelings got by the touch with his/her hands.

The perforation/perforations of the outer packaging box 2, the convex shape/shapes of the ink cartridge 3, and the convex section of the cartridge setting section 4 correspond to each other, by the color of the ink. Therefore, even in a case where the user does not know which color the convex shape or the perforation indicates, the user can replace the ink cartridge 3, by identifying each shape with tactile sense.

Therefore, according to the present invention, replacement of a replacement part such as an ink cartridge, etc., which is difficult for a visually impaired person, etc., can be carried out smoothly. Also, for people who are not visually impaired, replacement of a replacement part can be carried out smoothly, in a case where the device is placed at a place where visibility is poor, such as on a shelf, at a dark place, or on the floor under a desk, etc.

The present invention is not limited to the above embodiment, and various changes and modifications are possible.

For example, in the above embodiment, it is described that an identifying section that comprises a round-shaped perforation or a group of perforations, or a convex shape or a group of convex shapes is respectively provided at the outer packaging box 2, the ink cartridge 3, and the cartridge setting section 4. However, the shape for the identifying section is not limited to a round-shape, a perforation, and a convex shape. The shape may be formed in the shape of, for example, a star or a triangle, a depressed state, or a slit, etc. so that the shapes can be identified by tactile sense. Also, it is not necessary that the outer packaging box 2, the ink cartridge 3, and the cartridge setting section 4 have the same shape. The shapes may be different as long as each shape is associated with a specified color. For example, a structure is available where alphabets such as, "B", "C", "M", and "Y", which are the initial letters of Black, Cyan, Magenta, and Yellow, are provided in a convex shape that can be identified by tactile sense, on the surface of the outer packaging box, while words such as "BLACK", "CYAN", "MAGENTA", and "YELLOW", which represent the colors, are provided in a convex shape that can be identified by tactile sense, on the cartridge setting section 4. Namely, identifying sections having outer shapes (shape, size, number, etc.) that can be recognized by the tactile sense of a person as being the same or as being corresponding, may be provided.

In the above embodiment, an example where the present invention is applied to a printer of an ink-jet-printing type, an ink cartridge, and the package of the ink cartridge, is shown. However, the printing method of the printer to which the present invention is applied, is not limited to the type above described, and for example, the present invention may be applied to a printer adopting another printing method, such as a laser printer using toner, or a thermal transfer printer using an ink ribbon, etc. Also, the shapes of the ink cartridge 3 and the cartridge setting section 4 (shape of the identifying section) to which the present invention is applied, are arbitrary. FIG. 5 shows an example of applying the present invention to a toner cartridge 3A of a laser printer, and a cartridge setting section 4A of a toner cartridge. The toner cartridge setting section 4A is a revolver type toner cartridge setting section 4A that rotates in a direction of an arrow YA shown in the drawing. As shown in FIG. 6A, the toner cartridge setting section 4A comprises four toner cartridge inserting sections 41A. Each toner cartridge inserting section 41A comprises a hemicyclic slit or slits (identifying section) at the edge of the inserting opening of each toner cartridge inserting section 41A. The number of slits indicates the color of the toner of the toner cartridge 3, that is to be inserted to each toner cartridge inserting section 41A. The number of slits corresponds to the color of the toner one to one, in such a way as, one slit=black, two slits=cyan, three slits=magenta, and four slits=yellow. As shown in FIG. 6B, the toner cartridge 3A has a cylindrical shape, and comprises a round convex shape/shapes at the base (front end shown in the perspective view of FIG. 6B). The number of convex shapes indicates the color of the toner of each toner cartridge 3A, and corresponds one to one, to the color of the toner, such as one convex shape=black, two convex shapes=cyan, three convex shapes=magenta, and four convex shapes=yellow. Also, as shown in FIG. 6C, the outer packaging 2A that stores the toner cartridge 3A comprises a round-shaped perforation or perforations positioned at a predetermined position on its surface. The number of perforations indicates the color of the toner of the toner cartridge 3A that is to be the content of the outer packaging 2A, and corresponds to the color of the toner one to one, such as one perforation=black, two perforations=cyan, three perforations=magenta, and four perforations=yellow. In this way, irrespective of the printing method and shapes of the cartridge and the cartridge setting section, by providing a three dimensional shape that can be identified by tactile sense, to the outer packaging box 2A, the toner cartridge 3A, and the toner cartridge inserting section 41A, a printer wherein the user can replace the cartridge by tactile sense, is realized.

In the above embodiment, an example where the present invention is applied to a color printer 1 and an ink cartridge 3 used for the color printer 1, is shown. However, the present invention can be applied to other things. For example, the present invention can be applied to a vending machine for soft drinks as follows. A soft-drink can, a box for packaging the soft-drink can and a refilling opening from which canned soft drinks are refilled to a vending machine, are provided with a shape that can be identified by a person with his/her tactile sense at their predetermined positions. This makes it possible to refill the canned soft drinks as merchandise to the vending machine under a bad visible condition.

Various embodiments and changes may be made thereunto without departing from the broad spirit and scope of the invention. The above-described embodiment is intended to illustrate the present invention, not to limit the scope of the present invention. The scope of the present invention is shown by the attached claims, rather than the embodiment. Various modifications made within the meaning of an equivalent of the claims of the invention and within the claims are to be regarded to be in the scope of the present invention.

This application is based on Japanese Patent Application No. 2003-388820 filed on Nov. 19, 2003 and including specification, claims, drawings, and summary. The disclosure of the above Japanese Patent Application is incorporated herein by reference in its entirety.

What is claimed is:

1. An electronics device used with plural types of replacement parts being set thereto, said electronics device comprising a plurality of setting sections in each of which corresponding one of said plural types of replacement parts is set, wherein:

said each setting section comprises an exterior surface with a first identifying section that has a configuration recognizable by touch alone that identifies said type of said replacement part that is to be set to said setting section;

each of said replacement parts, in accordance with its type, has an exterior surface with a second identifying section that has a configuration recognizable by touch alone that corresponds to the configuration of said first identifying section of said setting section so as to identify which one of the setting sections into which said each replacement part is to be set; and each replacement part is supplied in a package that also has a configuration recognizable by touch alone that also corresponds to respective ones of the setting sections so as to identify each replacement part and which of the setting sections each replacement part is to be set in.

2. The electronics device according to claim 1, wherein said replacement part stores a predetermined consumables used in said electronics device, and said second identifying section of said replacement part has an outer surface with a configuration recognizable by touch alone that also identifies the consumables.

3. The electronics device according to claim 1, wherein:

said electronics device is a printing device; and said replacement part stores an ink used for printing by said printing device, and said second identifying section of said replacement part has an outer surface with a configuration recognizable by touch alone that also identifies said ink stored in said replacement part.

4. Plural types of replacement parts used by being set to an electronics device, wherein:

said electronics device comprises a plurality of setting sections in each of which corresponding one of said plural types of replacement parts is set for operating the electronic device;

each of said replacement parts, in accordance with its type, comprises an exterior surface with an identifying section that has a configuration recognizable by touch alone that identifies one of said setting sections as a setting section in which a corresponding replacement part is to be set; and each said replacement part is supplied inside of a package that has a configuration recognizable by touch alone corresponding to the configuration of the identifying section to indicate the type of replacement part in the package and the setting section where the replacement part inside the package is to be set.

5. The replacement parts according to claim 4, wherein:

said electronics device is a printing device;

said replacement part stores ink for said printing device; and said identifying section of said replacement part and of said package has a configuration that identifies said ink stored in said replacement part.

* * * * *